United States Patent [19]

Phelan et al.

[11] 4,187,814

[45] Feb. 12, 1980

[54] ALTITUDE COMPENSATION APPARATUS

[75] Inventors: Michael B. Phelan; Jack M. White, both of Florissant, Mo.

[73] Assignee: ACF Industries, Incorporated, New York, N.Y.

[21] Appl. No.: 878,244

[22] Filed: Feb. 16, 1978

[51] Int. Cl.[2] ..... F02M 11/00

[52] U.S. Cl. ..... 123/119 EC; 123/139 AW; 60/276

[58] Field of Search ..... 123/119 EC, 139 AW; 60/285, 276

[56] References Cited

U.S. PATENT DOCUMENTS

| | | | |
|---|---|---|---|
| 3,780,718 | 12/1973 | Nambu et al. | 123/119 EC |
| 3,880,125 | 4/1975 | Kammerer et al. | 123/139 AW |
| 3,906,910 | 9/1975 | Szlaga, Jr. | 123/119 EC |
| 3,912,796 | 10/1975 | Brown | 60/285 |
| 4,015,566 | 4/1977 | Wahl | 60/285 |
| 4,040,394 | 8/1977 | Wahl et al. | 60/285 |
| 4,052,968 | 10/1977 | Hattori et al. | 123/119 EC |
| 4,057,002 | 11/1977 | Aono | 123/119 EC |
| 4,075,982 | 2/1978 | Asano et al. | 60/285 |
| 4,083,338 | 4/1978 | Bertling et al. | 123/119 EC |
| 4,084,560 | 4/1978 | Hattori et al. | 123/119 EC |
| 4,086,890 | 5/1978 | Minami et al. | 123/119 EC |

*Primary Examiner*—Charles J. Myhre
*Assistant Examiner*—R. A. Nelli
*Attorney, Agent, or Firm*—J. Joseph Muller

[57] ABSTRACT

Altitude compensation apparatus for use with a carburetion system for an internal combustion engine, the system having a passage through which air is drawn into the engine, a throttle valve positioned in the passage and movable between an open and a closed position to control the flow of air therethrough and a fuel circuit through which fuel is delivered to the passage for mixing with air to form an air-fuel mixture combusted in the engine. The position of the throttle valve, the flow rate of air through the passage and the vacuum level in the engine are each sensed and respective electrical signals representative thereof are supplied. The quantity of fuel supplied by the fuel circuit to the passage is metered thereby to maintain the air-fuel ratio of the mixture produced at a preselected value. In response to the aforesaid signals, the density of air being drawn into the engine is calculated and a control signal is generated to control the metering of fuel. The calculated air density is a function of the altitude at which the engine is operated and the control signal has characteristics which are a function of the calculated air density.

8 Claims, 3 Drawing Figures

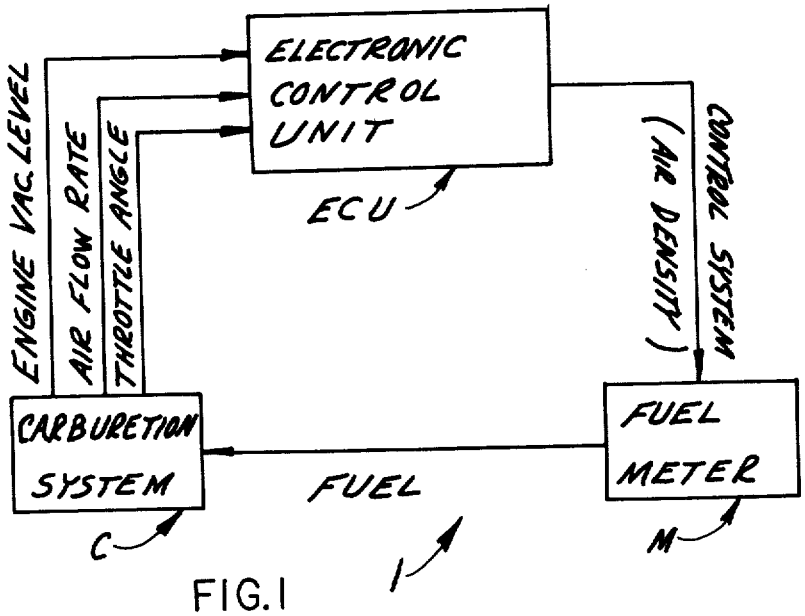
FIG. 1
FIG. 2
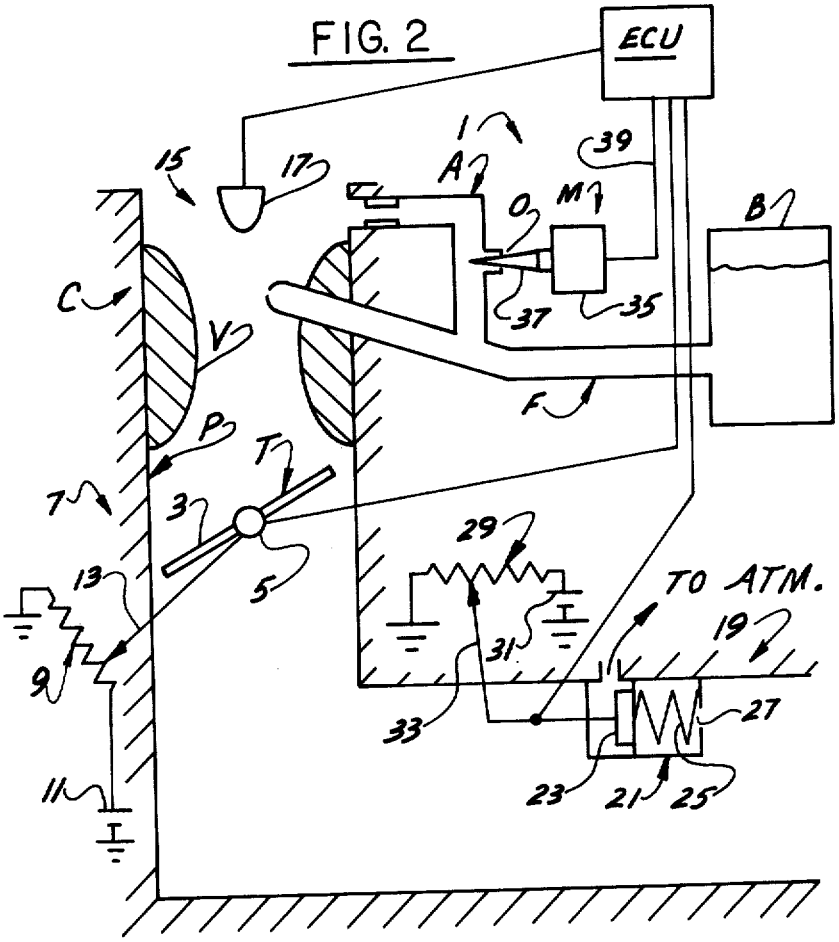

ALTITUDE COMPENSATION APPARATUS

BACKGROUND OF THE INVENTION

This invention relates to carburetion systems for internal combustion engines and more particularly to a carburetion system in which adjustments in the delivery of fuel are made to compensate for changes in altitude.

With the present emphasis on fuel economy and reduced engine emissions for automobiles, numerous schemes have been developed for controlling the quantities of air and fuel mixed together and supplied to an automobile engine for combustion. A number of factors determine the correct proportions of air and fuel and one of these factors is the altitude at which an engine is operated. As an engine is operated at higher altitudes, less air is drawn into the engine and the resultant air-fuel mixture tends to become richer unless a correction is made in the quantity of fuel supplied to the engine. One way of compensating for altitude changes in a conventional carburetor is disclosed in U.S. Pat. No. 3,872,188 issued Mar. 18, 1975 to Brown et al and assigned to the same assignee as the present application. As shown in this patent, a capsule or bellows is responsive to changes in atmosphere to adjust the position of a metering pin and bleed more or less air into a carburetor fuel system, thereby controlling the quantity of fuel delivered to the engine. While such an apparatus does improve fuel economy and reduce emissions, the mechanical parts are subject to failure due to wear, engine vibrations, heat, etc. Further, other carburetion systems for an automobile engine do not function in the same manner as conventional carburetors but altitude compensation is still necessary to obtain the above stated goals.

SUMMARY OF THE INVENTION

Among the several objects of the present invention may be noted the provision of altitude compensating apparatus for use with a carburetion system for an internal combustion engine; the provision of such apparatus which may be used both with a conventional carburetor and with other types of carburetion systems; the provision of such apparatus for maintaining the air-fuel ratio of the mixture supplied to the engine at a preselected value; and the provision of such apparatus which promotes fuel economy and reduced engine emissions and which is less susceptible to wear or failure.

Briefly, altitude compensation apparatus of the present invention is for use with a carburetion system for an internal combustion engine, the system having a passage through which air is drawn into the engine, a throttle valve positioned in the passage and movable between an open and a closed position to control the flow of air therethrough and a fuel circuit through which fuel is delivered to the passage for mixing with air to form an air-fuel mixture combusted in the engine. The apparatus comprises respective means for sensing the position of the throttle valve, the flow rate of air through the passage and the vacuum level in the engine and for supplying respective electrical signals representative thereof. The quantity of fuel supplied by the fuel circuit to the passage is metered thereby to maintain the air-fuel ratio of the mixture produced at a preselected value. Means responsive to the aforesaid signals calculates the density of air being drawn into the engine and generates a control signal to control the metering of fuel. The air density calculated by the signal responsive means is a function of the altitude at which the engine is operated and the control signal has characteristics which are a function of the calculated air density. Other objects and features will be in part apparent and in part pointed out hereinafter.

BRIEF DESCRIPTION OF THE DRAWINGS

FIG. 1 is a block diagram of altitude compensation apparatus of the present invention;

FIG. 2 is a diagrammatic representation of a first embodiment of the apparatus of the present invention.

Corresponding reference characters indicate corresponding parts throughout the several views of the drawings.

DESCRIPTION OF PREFERRED EMBODIMENTS

Figure 3:
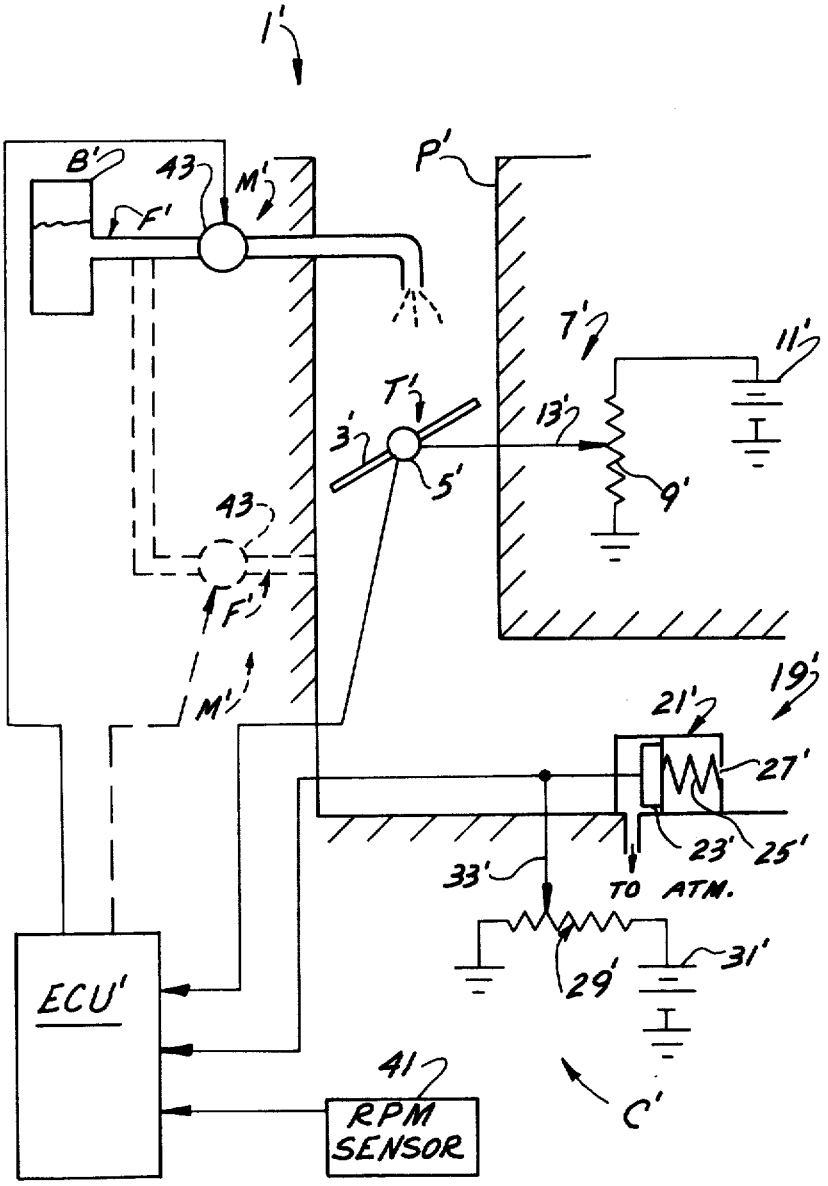
FIG. 3 is a diagrammatic representation of a second embodiment of the apparatus of the present invention.

Referring to the drawings, altitude compensation apparatus of the present invention is designated generally 1 and is for use with a carburetion system C for an internal combustion engine (not shown). As shown in FIG. 2, the carburetion system has a passage P through which air is drawn into the engine, the passage having a restriction or venturi V. A throttle valve generally indicated T is positioned in the passage and is comprised of a movable plate 3 mounted on a rotatable shaft 5 for movement of the throttle valve between an open and a closed position to admit more or less air into the engine. It will be understood that the throttle valve structure shown in FIG. 2 is for illustrative purposes only and that other throttle valve designs would serve equally well in practicing the present invention. Fuel is delivered from a fuel source, a fuel bowl B, to air passage P through a fuel circuit F. The fuel and air mix to form an air-fuel mixture combusted in the engine.

Apparatus 1 comprises means 7 for sensing the position of throttle valve T and for supplying an electrical signal representative of the position. The means includes a potentiometer 9 connected between a battery 11 and electrical ground. The resistance of the potentiometer is a function of the extent to which the throttle valve is open. Wiper arm 13 of the potentiometer is operatively connected to the throttle valve to change the resistance value of the potentiometer as the throttle valve moves between its fully open and closed positions.

A second sensing means 15 senses the flow rate of air through passage P and supplies an electrical signal representative of the flow rate. Sensing means 15 may be any of a number of flow rate sensors whose design and operation are well known in the art. As shown in FIG. 2, the sensing means comprises a vortex-shedding flowmeter 17, the design and operation of which is well known in the art and is described, for example, in "Vortex shedding provides accurate flow", *The Oil and Gas Journal*, Aug. 4, 1975, pp. 84–88.

A third sensing means 19 senses the vacuum level in the engine and supplies an electrical signal representative of this level. As shown in FIG. 2, means 19 is a differential pressure sensor and comprises a housing 21 in which a piston 23 is slidably movable and a spring 25 seated against the piston and one end of the housing. The housing has an opening 27 in the end against which spring 25 seats and the opposite end of the housing is vented to the atmosphere. Sensing means 19 further includes a potentiometer 29 connected between electrical ground and a battery 31. Wiper arm 33 of the potentiometer is operatively connected to piston 23 to change the resistance value of the potentiometer as the absolute pressure level (engine vacuum level) changes.

An auxiliary air passage A communicates with fuel circuit F. The inlet to this auxiliary air passage is shown in FIG. 2 as being in air passage P at a point above Venturi V. It will be understood however, that the inlet to passage A may be at some other location. A portion of the air entering air passage P enters auxiliary passage A and modulates the pressure to which fuel circuit F is subjected.

A fuel metering means M meters the quantity of fuel supplied by the fuel circuit to passage P to maintain the air-fuel ratio of the resultant mixture at a preselected value. As shown in FIG. 2, means M comprises a solenoid 35 and an air metering rod 37 movable by the solenoid. The metering rod extends into auxiliary air passage A through an opening O therein.

The metering rod is movable into and out of the auxiliary air passage to adjust the quantity of air flowing therethrough to fuel circuit F. An increase or decrease in the amount of air flowing to fuel circuit F results in less or more fuel flowing to passage P.

The flow of air through auxiliary air passage A is controlled on the basis of the density of the air being drawn into the engine. An electronic control unit ECU is responsive to the signals supplied by sensing means 7, 15 and 19 to calculate the density of the air being drawn into the engine. The electronics control unit calculates the air density according to the formula $$\text{air density} = \frac{(\text{engine vacuum})\,(\text{flow area})^2\,(2g_c)}{(\text{volumetric air flow})^2\left(1 - \left[\dfrac{\text{flow area}}{\text{bore area}}\right]^2\right)}$$

where flow area is a function of the position of throttle valve T, $g_c$ is the gravitational constant, volumetric air flow is a function of the flow rate of air through the engine and bore area is a constant equal to the cross-sectional area of passage P. This formula is derived from the flow equation for carburetors which, in turn, is derived from Bernoulli's equation. The basic flow equation is set forth, for example, in *Introduction to Fluid Mechanics*, by James E. A John and William Haberman, Prentice Hall, Inc. 1971, p. 45, as well as in *Elements of Internal-Combustion Engines* by A. B. Rogowski, McGraw-Hill Book Company, 1953, p. 142. The electronics control unit is, for example, a microprocessor, having appropriate input, output and memory circuits of the type well known in the art. This circuitry responds to the three input signals from carburetion system C to calculate air density in accordance with the formula and supply a control signal to the metering means to control the metering of fuel. As shown in FIG. 2, the control signal is supplied from unit ECU to solenoid 35 via electrical path 39. The control signal has characteristics which are a function of the calculated air density. Thus, for example, the control signal may be frequency variable with the frequency varying as a function of calculated air density or the control signal may be a d.c. level the amplitude of which varies as a function of calculated air density.

Altitude compensation apparatus 1 of the invention is summarized in block diagram form in FIG. 1. Thus, a carburetion system C provides three output signals to an electronics control unit ECU; these signals being representative of throttle position or angle, air flow rate and engine vacuum. The electronics control unit employs these signals to calculate air density according to the above stated formula and produces a control signal which is supplied to a fuel meter M. The fuel meter is responsive to the control signal to supply an appropriate amount of fuel to the carburetion system for proper operation of the engine at a given altitude. The resultant air-fuel mixture produced by the carburetion system may be held at a specific air-fuel ratio and this helps increase fuel economy and reduce emissions. In addition, the parts employed in the apparatus are not as susceptible to wear or breakdown as mechanical systems performing a similar function.

Referring to FIG. 3, a second embodiment of altitude compensation apparatus of the invention is indicated 1' and is for use with a carburetion system C' having an air passage P'; a throttle valve T'; a source of fuel B' and a fuel circuit F'. Throttle valve T' position is sensed by a sensing means 7' as before and engine vacuum is sensed by a sensing means 19' also as before. The electrical signals developed by these sensing means are supplied to an electronics control unit ECU'. Concerning flow rate, the engine on which carburetion system C' is installed may be considered as a positive displacement pump or meter which ingests a quantity of air and fuel approximately equal to its volumetric displacement during each complete engine cycle. For a 2-cycle engine, a complete cycle occurs every engine revolution; while for a 4-cycle engine, a complete cycle occurs every two engine revolutions. Thus, the flow rate may be measured without a separate flow measuring device by measuring engine revolutions.

If, for example, the engine on which carburetion system C', is employed is a 4-cycle engine, then $$\text{volumetric air flow} = \frac{(\text{engine revolutions per minute})}{2} \times (\text{engine displacement}) \times (\text{volumetric efficiency proportionality constant})$$

Engine revolutions per minute (rpm) is measured by an rpm sensor 41. Rpm sensor 41 is of any type well known in the art and an electrical signal produced by the rpm sensor is supplied to electronics control unit ECU'. The volumetric efficiency proportionality constant is equal to $$\frac{\text{air density at engine vacuum}}{\text{air density at atmospheric pressure}}$$

A discussion of volumetric efficiency is found in *Internal Combustion Engines* by Burgess H. Jennings and Edward F. Obert, International Textbook Company, 1944, pp. 133–134. By making the appropriate substitutions, the previously set forth air density formula, by which electronic control unit ECU' computes air density, becomes air density $$= \frac{(\text{engine vacuum})\,(\text{flow area})^2\,(8g_c)}{(\text{engine rpm})^2\,(\text{engine displacement})^2\,(\text{volumetric efficiency})^2} \times \frac{1}{\left(1 - \left[\dfrac{\text{flow area}}{\text{bore area}}\right]^2\right)}$$

As before, the electronics control unit computes air density in response to the signals supplied to it representing throttle angle, engine vacuum and air flow. Further, the electronics control unit produces a control signal whose characteristics are a function of the calculated air density and this signal is supplied to a fuel metering means M'. This means comprises a positive displacement fuel pump 43 which pumps fuel from fuel bowl B' to passage P' via fuel circuit F'. The outlet of fuel circuit F' is at a point above throttle valve T' although alternately, and as shown by the dashed lines, the fuel circuit outlet may be below the throttle valve. In operation, the amount of fuel delivered to passage P' via pump 43 is determined by the characteristics of the control signal and the fuel pump pumps an amount of fuel necessary to maintain the air-fuel ratio of the resultant mixture at a preselected value.

As above noted, the electronics control unit may comprise a microprocessor which includes a memory. An electronics control unit of this type was constructed for use with a carburetion system C' as shown in FIG. 3. The apparatus was installed on an automobile which was then driven from lower to higher altitudes. At preselected altitudes, the air density was computed according to the abovestated formula and the quantity of fuel required to produce an air-fuel mixture of a specified air-fuel ratio, for example, for stoichiometry was calculated. The resultant values were tabulated and a schedule developed which was loaded into the memory of electronic control unit ECU'. The automobile was then driven from the higher back to lower altitudes and it was determined that the performance of the altitude compensation apparatus at the altitudes for which the initial data was taken was in accordance with the expected results.

In view of the above, it will be seen that the several objects of the invention are achieved and other advantageous results attained.

As various changes could be made in the above constructions without departing from the scope of the invention it is intended that all matter contained in the above description or shown in the accompanying drawings shall be interpreted as illustrative and not in a limiting sense.

What is claimed is:

1. Altitude compensation apparatus for use with a carburetion system for an internal combustion engine, said system having a passage through which air is drawn into said engine, a throttle valve positioned in said passage and movable between an open and a closed position to control the flow of air therethrough and a fuel circuit through which fuel is delivered to said passage for mixing with air to form an air-fuel mixture combusted in said engine, the apparatus comprising:

means for sensing the position of said throttle valve and for supplying an electrical signal representative thereof;

means for sensing the flow rate of air through said passage and for supplying an electrical signal representative thereof;

means for sensing the vacuum level in said engine and for supplying an electrical signal representative thereof;

means for metering the quantity of fuel supplied by said fuel circuit to said passage thereby to maintain the air-fuel ratio of the mixture produced at a preselected value; and means responsive to the aforesaid signals for calculating the density of air being drawn into said engine and for generating a control signal which is supplied to said metering means to control the metering of fuel thereby, the air density calculated by said signal responsive means being a function of the altitude at which said engine is operated and said control signal having characteristics which are a function of the calculated air density.

2. Apparatus as set forth in claim 1 wherein said signal responsive means calculates air density according to the formula $$\text{air density} = \frac{(\text{engine vacuum})\,(\text{flow area})^2\,(2g)}{(\text{volumetric air flow})^2\left(1 - \frac{(\text{flow area})^2}{(\text{bore area})}\right)}$$

where flow area is a function of the position of said throttle valve, $g_c$ is the gravitational constant, volumetric air flow is a function of the flow rate of air through said engine and bore area is a constant equal to the cross-sectional area of said passage.

3. Apparatus as set forth in claim 2 wherein said vacuum level sensing means includes means for sensing the differential pressure in said engine.

4. Apparatus as set forth in claim 3 wherein said vacuum level sensing means includes a potentiometer whose resistance value is a function of the differential pressure in said engine.

5. Apparatus as set forth in claim 3 wherein said throttle valve sensing means comprises a potentiometer whose resistance value is a function of the extent to which said throttle valve is open.

6. Apparatus as set forth in claim 3 wherein said carburetion system includes an auxiliary air passage in communication with said fuel circuit and said metering means includes means for adjusting the quantity of air flowing through said auxiliary air passage, the flow of air into said fuel circuit modulating the pressure to which said fuel circuit is subjected thereby to control the quantity of fuel supplied by said fuel circuit.

7. Apparatus as set forth in claim 2 wherein said engine is a positive displacement air pump/meter and ingests a quantity of air and fuel approximately equal to its volumetric displacement during each complete engine cycle, said air flow rate sensing means comprises means for sensing the revolutions of said engine for a predetermined unit of time and said signal responsive means determines the number of complete engine cycles for said unit of time on the basis of the number of revolutions sensed.

8. Apparatus as set forth in claim 7 wherein said metering means is a fuel metering pump responsive to the control signal supplied by said signal responsive means to deliver fuel from a source thereof to said passage, the quantity of fuel so delivered being determined by the characteristics of said control signal.

* * * * *